United States Patent [19]

Lücke

[11] 4,229,110

[45] Oct. 21, 1980

[54] MIXING MACHINE WITH WEDGE-SHAPED OR PLOUGHSHARE-LIKE MIXING TOOLS

[75] Inventor: Roland Lücke, Paderborn, Fed. Rep. of Germany

[73] Assignee: Gebruder Lodige Maschinenbau GmbH of Elsener Str., Paderborn, Fed. Rep. of Germany

[21] Appl. No.: 1,902

[22] Filed: Jan. 8, 1979

[30] Foreign Application Priority Data

Jan. 13, 1978 [DE] Fed. Rep. of Germany ..... 2801460

[51] Int. Cl.[3] ..... B01F 7/00

[52] U.S. Cl. ..... 366/343

[58] Field of Search ..... 366/343, 325, 329, 64, 366/65, 66, 67, 326, 327, 331, 279, 292

[56] References Cited

FOREIGN PATENT DOCUMENTS

| | | | |
|---|---|---|---|
| 1136890 | 9/1962 | Fed. Rep. of Germany | 366/64 |
| 1276986 | 9/1968 | Fed. Rep. of Germany | 366/66 |
| 1188455 | 4/1970 | United Kingdom | 366/64 |

*Primary Examiner*—Robert W. Jenkins

*Attorney, Agent, or Firm*—Alfred D. Lobo

[57] ABSTRACT

An impeller-type mixing machine is provided with movable wedge-shaped or ploughshare shaped mixing tools. Each tool has a tip running upstream and lateral cheeks emanating from it and acting as working surfaces. At least one of the cheeks is placed obliquely to the direction of movement of the mixing tools. The cheeks of each mixing tool run at an obtuse angle to the longitudinal axis thereof.

1 Claim, 4 Drawing Figures

FIG.2
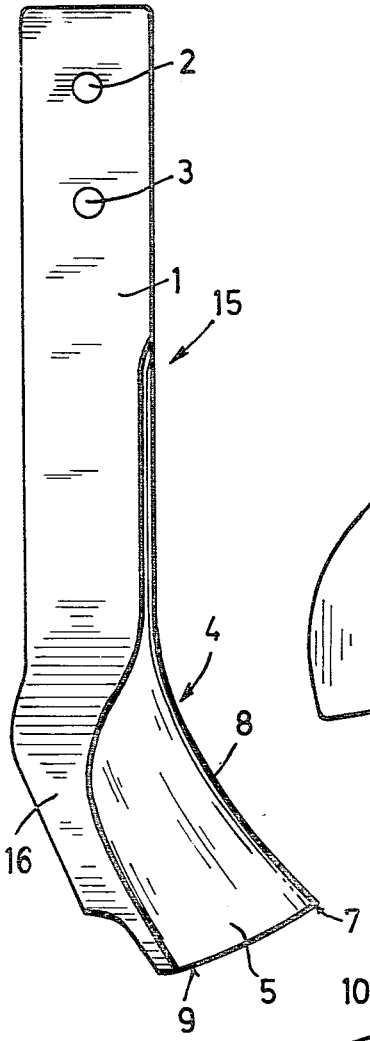
FIG.3
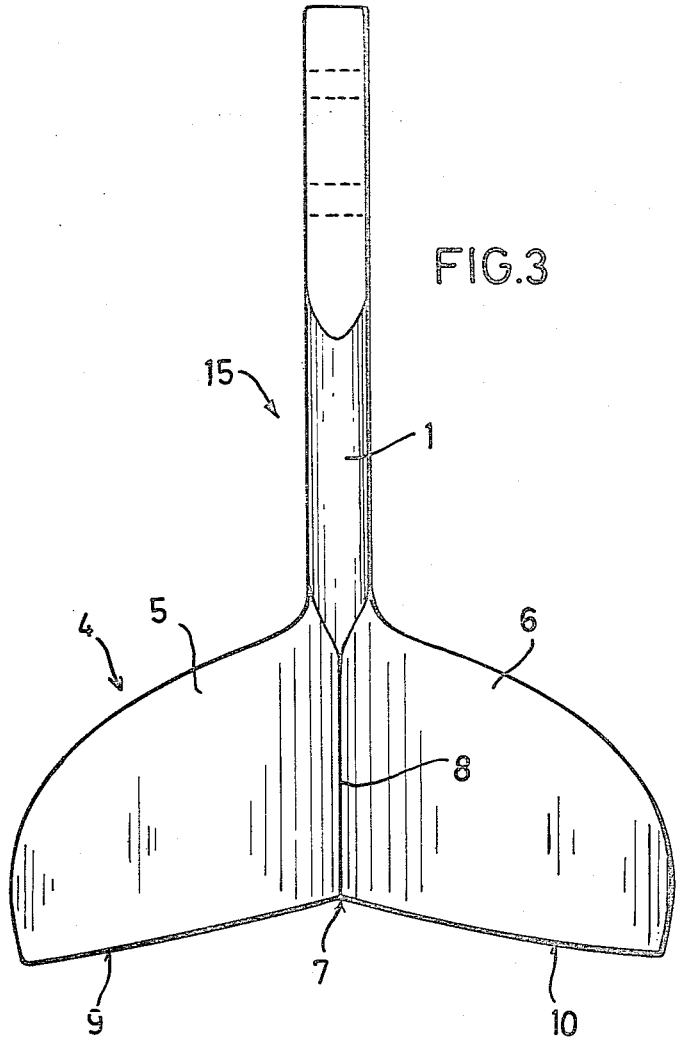
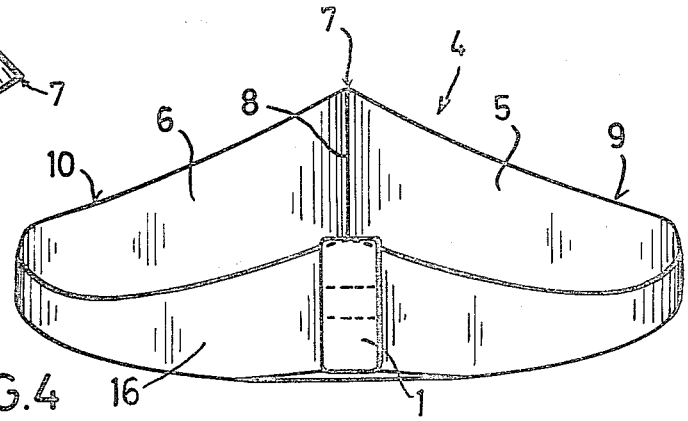
FIG.4

MIXING MACHINE WITH WEDGE-SHAPED OR PLOUGHSHARE-LIKE MIXING TOOLS

FIELD OF THE INVENTION

The invention relates to a mixing machine with wedge-shaped or ploughshare-like mixing tools which each have a tip running upstream and lateral cheeks emanating from it and acting as working surfaces, at least one of which is placed obliquely to the direction of travel of the mixing tool. In this arrangement, the cheeks can form a flat surface or can be curved concavely and/or convexly. The mixing machines concerned are those which are intended for and are suitable as push and impeller mixers.

BACKGROUND OF THE INVENTION

Mixing machines with ploughshare-like mixing tools have been known for a long time and have proven suitable for a wide variety of mixing problems. These mixing tools plough through the material being mixed located in a drum-shaped or similar mixing container and in so doing produce not only a mixing effect but also lateral conveying, i.e. conveying of the material being mixed in the axial direction of the mixing container. In the past, it was always necessary to treat the material being mixed as gently as possible, so the mixing tools were designed as bodies which were as thin as possible, i.e. the projection of the lateral cheeks on a plane normal to the direction of travel of the mixing tool was kept small so that the material being mixed resists the mixing tool passing through it as little as possible and no accumulation of material forms in front of individual mixing tools, but instead the material being mixed passes by the lateral cheeks of the body of the mixing tool member with as little obstruction as possible. However, it being desirable to treat the material being mixed as gently as possible, it is necessary, in order to achieve a predetermined mixing result with prior art ploughshare-shaped mixing tools, to allow for relatively long mixing times which, in turn, are detrimental to gentle treatment of the material being mixed.

Mixing machines with paddle-like mixing tool members are also known. The mixing tools are placed obliquely to their direction of travel and therefore stress the material being mixed to a greater extent. It has however been found that mixing tools of this type operate with relatively poor efficiency, so that in spite of the greater force on the material being mixed, the mixing time cannot be reduced. In many cases, an accumulation of material also builds up in front of paddle-like mixing tools of this type, and this accumulation certainly contributes to the fact that the mixing times are relatively long.

SUMMARY OF THE INVENTION

The object of the invention is to improve the efficiency and to achieve uniform mixing results within shorter times with mixing machines having wedge-shaped or ploughshare-like mixing tool members.

According to the invention there is provided a mixing machine with movable wedge-shaped or ploughshare shaped mixing tool members each of which has a wedge-shaped body having a tip running upstream and lateral cheeks acting as working surfaces which are oppositely disposed relative to the longitudinal center line of the wedge-shaped body, at least one of the cheeks being placed obliquely to the direction of movement of the mixing tool members, wherein the cheeks of each mixing tool are disposed with an obtuse included angle to the longitudinal axis of the mixing tool member.

Each of the cheeks of the wedge-shaped body is angularly disposed at an angle to the longitudinal axis of each of the respective mixing the included angle of the cheeks corresponding substantially to the internal breaking lines of the material being mixed as a working surface passes through it, i.e., it is an object of the invention to provide the external contour of the cheeks corresponding substantially approximately to the internal breaking lines of the material being mixed.

Since the internal breaking lines of the material being mixed can be different curves for different materials, it is at such times as the curves are different, to provide mixing tool members with bodies having different contours or working surfaces which are designed and positioned in a different way, for different mixing problems.

The internal breaking lines of a certain material being mixed may be determined if a flat surface is pulled or pushed through the material being mixed at a right angle so that an accumulation of material builds up in front of it and pushes the surface in front of it. This accumulation of material assumes the shape of a cone determined by the internal friction of the material being mixed, i.e. the friction between its particles, the limiting surface of which represents the breaking line. These breaking lines can be determined experimentally for virtually any mixable material. As they are similar for many materials wedge-shaped or ploughshare-shaped mixing tools of identical contour can be used for a large proportion of mixing problems.

In contrast to the known ploughshare-shaped mixing tool members, which have a body as thin as possible with an acute angle included between the cheeks, the body of a mixing tool members in the mixing machine according to the invention are as wide as possible so that the material being mixed puts up a relatively large resistance to the body of the mixing tool members passing through it and the material being mixed is consequently stressed to a greater extent for each passage of the mixing tool members passing through it. This improves the efficiency of this mixing tool, although the power requirement is somewhat higher per unit time. It has, however, been found that the improvement in the efficiency greatly outweighs the higher energy requirement, particularly since the reduction achieved in the mixing times in the final analysis reduces the risk of adverse effects on the material being mixed. In particular, the mixing tool members in the mixing machine according to the invention also exert an optimum lateral conveying component on the material being mixed, so that the axial movement of the material being mixed is significantly improved over known mixing machines with ploughshare-shaped bodies. This is of importance for the mixing process, and for the passage of the material being mixed through the mixing container.

The mixing times needed for achieving a given mixing result can be reduced significantly with the mixing machine according to the invention. Since the friction on the material being mixed is increased with the mixing tool members of the invention, a mixing machine of this type is also suitable for heating up products by friction.

An embodiment of the mixing machine according to the invention and details of a ploughshare-shaped mixing tool thereof are illustrated in the drawings.

BRIEF DESCRIPTION OF THE DRAWINGS

FIG. 2 shows a side view of a mixing tool on a larger scale than that in FIG. 1.

FIG. 3 shows a front view of the mixing tool of FIG. 2.

FIG. 4 shows a plan view of the mixing tool of FIG. 2.

DETAILED DESCRIPTION OF THE PREFERRED EMBODIMENT

Figure 1:
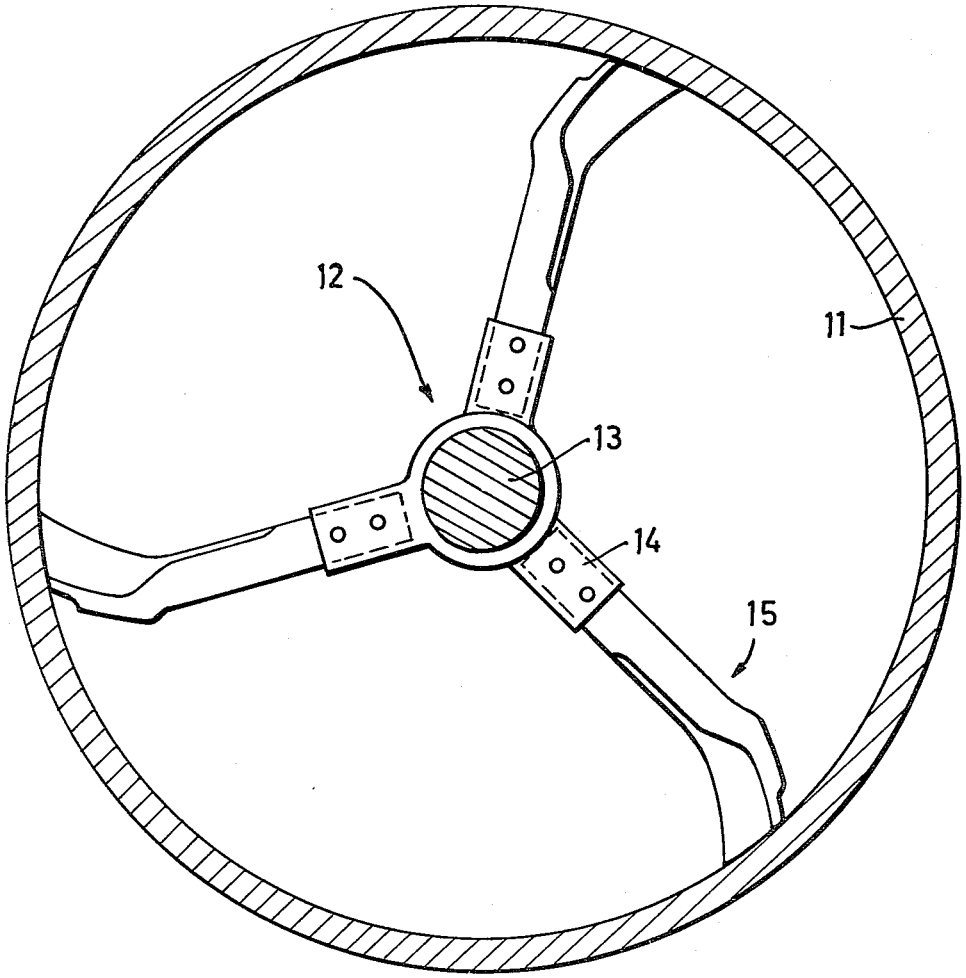
FIG. 1 shows a cross-section through the mixing container of the mixing machine.

The mixing machine has a cylindrical container 11 with a mixing tool 12 rotatably mounted therein which comprises a rotatably mounted shaft 13 connected to a drive mechanism (not shown) and sleeves 14 arranged thereon in each of which is placed and fixed an arm 1 of a respective mixing tool member 15. The arms 1 are of rectangular cross-section and has apertures 2 and 3 therethrough to enable them to be fixed in the sleeves 14.

Each mixing tool member 15 supports at the lower end of its arm 1, a body 4 formed in the shape of a ploughshare. In the embodiment illustrated, this body 4 has concavely curved cheeks 5 and 6 on the front face as working surfaces which lie at an obtuse included angle to each other and to the longitudinal axis of the mixing tool member, as shown particularly clearly in FIG. 3. The longitudinal axis of the mixing tool member 15 coincides with the longitudinal axis of arm 1 and lies in the same plane with an edge 8 which runs from the arm 1 to the front tip 7 of the body 4 and which also forms the internal limit of the cheeks 5 and 6. The cheeks 5 and 6 are themselves curved and arranged at such an angle to each other and to the longitudinal axis of the tool that their surface conforms approximately with the breaking lines of the material to be mixed by this tool.

The lower edges 9 and 10 of the cheeks 5 and 6 are adapted to the contour of the internal wall of the mixing container 11 so that these edges revolve at a distance from this internal wall which is as small as possible and thus prevent the formation of deposits on the wall as far as possible, or at least break them up again immediately they are formed.

The rear portion 16 of the ploughshare-shaped body 4 can be solid or hollow, and, if hollow, is open, so that particles of material being mixed cannot settle in the body 4.

It can be seen that the cheeks 5 and 6 meet the material being mixed over a large area as the mixing tool member 15 passes through the material, and the cheeks consequently mix the material very intensively. In so doing, the mixing tool member 15 runs through the material being mixed in such a way that its tip 7 is firstly immersed into the material being mixed i.e. the working direction of the mixing tool member 15 lies in the same plane with the longitudinal axis thereof and thus with the edge 8. For this purpose each of, the mixing tool members 15 are fixed on the shaft 13 which is rotatably mounted axially in the mixing container 1.

When an obtuse-angled positioning of the cheeks 5 and 6 to the longitudinal axis of the body 4 of each mixing tool 15 is referred to herein, it should be noted that the cheeks 5 and 6 do not always present flat working surfaces but can be curved outwards and/or inwards. However, the cheeks 5 and 6 are positioned relative to the longitudinal axis of the body 4 in such a way that all portions of each surface lie at an obtuse included angle to the plane through the longitudinal axis of the mixing tool member 15 and edge 8 of body 4, even where each cheek has a concave or convex.

The mixing machine is a so-called push mixer or impeller mixer in which the material being mixed is pushed through itself and pushed or thrown to the outlet by the mixing tools 15 revolving in the container 11 and, in the process, worked in accordance with the known centrifuge and whirling method.

I claim:

1. A mixing machine for particulate material, said machine having movable wedge-shaped or ploughshare shaped mixing tool members each of which has a body having a tip running upstream and lateral cheeks which are oppositely disposed relative to the longitudinal center line of said body, said cheeks acting as working surfaces, each of the cheeks being disposed obliquely to the direction of movement of the mixing tools, wherein the cheeks of said body are disposed with an obtuse included angle to present working surfaces at an angle which corresponds substantially to the breaking lines for said material.

* * * * *